US012103748B2

(12) United States Patent
Berroa Garcia

(10) Patent No.: US 12,103,748 B2
(45) Date of Patent: Oct. 1, 2024

(54) STOPPER DEVICE INTENDED TO BE ATTACHED TO THE NECK OF A CONTAINER

(71) Applicant: BETAPACK, S.A.U., Guipuzcoa (ES)

(72) Inventor: Francisco Javier Berroa Garcia, Guipuzcoa (ES)

(73) Assignee: BETAPACK, S.A.U., Guipuzcoa (ES)

( * ) Notice: Subject to any disclaimer, the term of this patent is extended or adjusted under 35 U.S.C. 154(b) by 0 days.

(21) Appl. No.: 17/752,269

(22) Filed: May 24, 2022

(65) Prior Publication Data

US 2023/0278765 A1 Sep. 7, 2023

(30) Foreign Application Priority Data

May 24, 2021 (EP) ..... 21382473

(51) Int. Cl.
*B65D 55/16* (2006.01)

(52) U.S. Cl.
CPC ..... *B65D 55/16* (2013.01); *B65D 2251/1008* (2013.01)

(58) Field of Classification Search
CPC ..... B65D 55/16; B65D 2251/1008
See application file for complete search history.

(56) References Cited

U.S. PATENT DOCUMENTS 4,394,918 A * 7/1983 Grussen ..... B65D 41/3428 215/253
6,474,491 B1 * 11/2002 Benoit-Gonin .... B65D 41/3428 220/263

FOREIGN PATENT DOCUMENTS

EP 3757033 A1 12/2020
EP 3766797 A1 * 1/2021 ..... B65D 41/3423
WO 20200193821 A1 10/2020
WO 20200227813 A1 11/2020

* cited by examiner

*Primary Examiner* — James N Smalley
(74) *Attorney, Agent, or Firm* — Hayes Soloway P.C.

(57) ABSTRACT

A capping device intended to be fixed to a neck of a container includes a lower ring, a cap, an articulation device that connects the cap and the lower ring, and a locking device configured to lock the cap when it is in a tilted open position. The locking device includes a stop protruding radially outwards and a protruding portion protruding axially from the lower ring. The stop and the protruding portion are configured in such a way that, when the cap is in the tilted open position, the stop abuts against the protruding portion, the portion protrusion having a radial thickness ε1 greater than a radial thickness ε2 of a first section of the lower ring outside some engaging zones.

9 Claims, 4 Drawing Sheets

STOPPER DEVICE INTENDED TO BE ATTACHED TO THE NECK OF A CONTAINER

CROSS-REFERENCE TO RELATED APPLICATIONS AND PRIORITY

This patent application claims priority from European Patent Application No. 21382473.3 filed May 24, 2021. This patent application is herein incorporated by reference in its entirety.

TECHNICAL FIELD

The invention relates to a capping device that is equipped with a cap and makes it possible to keep said cap fixed to the neck of a container, which prevents the cap from being lost forever.

TECHNOLOGICAL BACKGROUND

Document WO20193821 discloses said capping device that allows the cap to be attached to the neck of a container. The capping device includes a lower ring which is intended to be mounted axially fixed on the neck of the container and rotatably movable with respect to it. The lower ring includes a first section that includes engaging elements that protrude radially inwards from the lower ring and are intended to be arranged below a neck hooking flange in order to retain the lower ring to the neck of the container. The lower ring also includes a second section that is articulated to the first section and can thus pivot with respect to the first section between a lowered position in which the second section is arranged below the hooking flange and a raised position in which the second section is arranged above the engaging flange. The capping device also includes a cap that has a top wall and a peripheral skirt that has a thread intended to cooperate with a thread on the neck. The cap is articulated in the second section of the lower ring by means of two sheets that connect the peripheral skirt and the second section. In this way, when the cap is unscrewed, the second section of the lower ring pivots with respect to the first section to the raised position in order to allow an axial movement, upwards the cap, from a closed position towards a released position. Furthermore, the two sheets allow the cap to tilt between said released position and a tilted open position.

The capping device also includes a locking device that allows the cap to be locked in the tilted open position. The capping device includes a lug arranged between the two elastic sheets and extending upwards from the lower ring and a stop protruding radially outwards from the outer peripheral skirt, the stop being arranged to bear against the lug during pivoting of the cap. Due to the abutment of the stop against the lug, the elastic sheets are subjected to an increasing tensile force during a first part of the movement of the cap from the released position towards the tilted open position to an intermediate unstable position. Then, the tensile force to which the elastic sheets are subjected decreases from said intermediate unstable position. This allows the cap to be locked in the tilted open position.

Such a device is not fully satisfactory.

In particular, in order to be able to abut against the lug when the cap is in the tilted open position, the stop has a relatively large radial dimension. However, a stop having a too large radial dimension is likely to adversely affect the reliability and performance of bottling operations in the course of which the capping devices are specifically transported on conveyors before being placed on the necks of the containers. A too prominent stop is also likely to hinder the user in handling the cap. Finally, a stop made of a significant quantity of plastic material is likely to create injection problems during the manufacture of the cap.

SUMMARY

An idea underlying the invention is to propose a capping device equipped with a cap attached to the neck of the container suitable for being screwed onto the neck of the container and allowing the cap to be reliably locked in an open tilted position in which it does not hinder the pouring of the contents of the container while limiting the dimension of the elements that protrude towards the outside of the cap.

Another idea underlying the invention is to obtain a large opening angle of the cap in the tilted open position in order not to hinder the pouring of the contents of the container.

According to one embodiment, the invention provides a capping device intended to be fixed to the neck of a container that includes a dispensing orifice, a helical thread and an engaging flange, the capping device including:

- a lower ring intended to be mounted axially fixed on the neck and mobile in rotation about an axis X, said lower ring including a first section, which includes engaging areas wherein each include at least one engaging element that protrudes radially towards the interior of the lower ring and is intended to be arranged below the engaging flange in order to axially retain the lower ring on the neck of the container and a second section, the first section and the second section of the lower ring being articulated with each other in such a way that the second section pivots with respect to the first section between a lowered position in which the second section is intended to be arranged below the engaging flange and a raised position in which the second section is intended to be arranged at least partially above the engaging flange,
- a cap including a top wall and an outer peripheral skirt, the outer peripheral skirt having a helical thread intended to cooperate with the helical thread of the neck in order to allow the movement of the cap between a closed position and a released position in which the helical thread of the cap is no longer engaged with the helical thread of the neck;
- an articulation device including two sheets connecting the outer peripheral skirt and the second section and configured to allow the cap to pivot between the released position and a tilted open position in which the cap is released from the dispensing orifice of the neck; the second section of the lower ring being able to position itself in the lowered position when the cap is in the tilted open position;

the capping device further including a locking device configured to lock the cap when it is in the tilted open position, said locking device including:

- a stop that protrudes radially outwards, from the external peripheral skirt, and is arranged circumferentially between the two sheets of the articulation device; and
  - a protruding portion that protrudes axially from a central portion of the second section of the lower ring, between the two sheets of the articulation device;
- the stop and the protruding portion being configured in such a way that, when the cap is in the tilted open position and the second section of the lower ring is in the lowered position, the stop abuts against the protruding portion, And wherein the outer peripheral skirt includes a heel that protrudes axially towards the protruding portion between the two sheets, the protruding portion having a radial thickness ε1 greater than a radial thickness ε2 of the first section of the lower ring outside some engaging areas and presenting some recesses that end in front of the heel.

In this way, the local increase in the thickness of the lower ring at least at the level of the protruding portion makes it possible to reduce the radial dimension of the stop accordingly. This is particularly advantageous insofar as a cap having a too large radial dimension is likely to impair the reliability and performance of bottling operations, is likely to hinder the user in handling the cap, and is also likely to create injection problems.

This increase in thickness also makes it possible to increase the rigidity of the protruding portion and further ensure the reliability and robustness of the locking device.

In addition, the recesses made on the protruding portion are likely to be formed, during the molding of the capping device, by reinforcing ribs of a steel sheet of the mold used. In this way, recesses of this type allow the radial dimension of the protruding portion to be increased without increasing the height of the gap between the protruding portion and the heel or causing said steel sheet to be damaged.

According to other advantageous embodiments, such a capping device can have one or more of the following features.

According to one embodiment, the radial thickness ε1 is between 0.4 and 2 mm, preferably between 1 and 2 mm.

According to one embodiment, the stop has an external face that extends axially in alignment with an external face of the central portion of the second section of the lower ring. In this way, the presence of angular surfaces between the protruding portion and the central portion of the lower ring is avoided, which makes it possible, in particular, to simplify the shape of the mold intended for making a capping device of this type.

According to one embodiment, the second section of the lower ring has two ends that are each connected to the first section of the lower ring and has an external face that progressively moves away from the axis X from each of the two ends of the second section towards the central portion of said second section. According to one embodiment, the second section of the lower ring has, between each of its ends and the central portion of the second section, an external face that is substantially incorporated into an ellipse portion with center X. This makes it possible to avoid the presence of angular surfaces likely to injure the user and simplify the shape of the mold intended for molding a capping device of this type.

According to one embodiment, the sheets are symmetrical to each other with respect to a radial plane of symmetry and the external face of the protruding portion and the external face of the central portion of the second section of the lower ring extend in a plane that is perpendicular to said radial plane of symmetry.

According to one embodiment, the stop has an end that extends in a plane that is perpendicular to said radial plane of symmetry and is parallel to the external face of the protruding portion.

According to one embodiment, the gap made axially between the heel and the protruding portion has a height of less than 0.6 mm, and preferably between 0.3 and 0.6 mm.

According to one embodiment, the stop has a beveled upper surface oriented such that the stop has a height that decreases from the external peripheral skirt towards one end of the stop, the stop being configured such that, in the tilted open position, the upper surface of the stop is abutting against the protruding portion. This allows increasing the opening angle of the cap.

According to one embodiment, the stop has an end that has a height of less than 1 mm, preferably less than 0.8 mm, for example of the order of 0.6 mm.

According to one embodiment, the first section includes a front area that is diametrically opposite to the second section and two engaging areas in which the engaging elements are positioned and which are located respectively on one side and the other of the front area between said front area and the second section.

According to one embodiment, the front area of the first section lacks engaging elements.

According to one embodiment, the engaging elements are arranged exclusively in the two engaging areas.

According to one embodiment, the protruding portion protrudes beyond a lower limit of the outer peripheral skirt.

According to one embodiment, the sheets and the locking device are configured in such a way that, during the pivoting movement of the cap between the released position and the tilted open position, the sheets are subjected to a tensile force that increases up to an intermediate unstable position and then decreases from said intermediate unstable position towards the tilted open position.

According to one embodiment, the capping device is molded in a single piece.

According to one embodiment, the lower ring is connected to the external peripheral skirt by frangible bridges.

According to one embodiment, when the cap is in the tilted open position and the second section of the lower ring is in the lowered position, the opening angle of the cap is greater than 120°, preferably greater than 180°, advantageously greater than 190° and, for example, of the order of 200°.

According to one embodiment, the outer peripheral skirt includes a notched portion and the elastic sheets are attached to said outer peripheral skirt at said notched portion. Such a configuration makes it possible to provide elastic sheets of sufficient length, while limiting the dimensions of the gaps made between the cap and the lower ring and which are likely to allow the passage of dust or undesirable external bodies.

According to one embodiment, the invention also provides an assembly that includes a capping device mentioned above and a container equipped with a neck, the neck including a orifice, a helical thread and an engaging flange, the engaging elements of the lower ring being arranged below the engaging flange in order to axially retain the lower ring on the neck of the container.

According to other advantageous embodiments, such an assembly may have one or more of the following features.

According to one embodiment, the stop and the protruding portion are configured in such a way that, when the cap is in the tilted open position and the second section of the lower ring is in the lowered position, the protruding portion is trapped between the stop and the engaging flange.

By virtue of such an arrangement, the locking device guarantees a robust locking, with a large angle, of the cap in its tilted open position.

According to one embodiment, the stop and the protruding portion are configured in such a way that, when the cap is in the tilted open position and the second section of the lower ring is in the lowered position, the stop and the protruding portion are in contact with each other in an area located in the plane of the engaging flange.

BRIEF DESCRIPTION OF THE FIGURES

The invention will be better understood and other purposes, details, features and advantages thereof will be more clearly appreciated during the following description of various particular embodiments of the invention, provided solely by way of illustration and not limitation, with reference to the attached drawings.

DESCRIPTION OF EMBODIMENTS

In the description and in the figures, the axis X corresponds to the axis of rotation of the cap 1 of the capping device when it is screwed onto the neck 2 of the container. By convention, "radial" orientation is directed orthogonal to the axis X and axial orientation is directed parallel to the axis X. The terms "external" and "internal" are used to define the relative position of one element with respect to another, with reference to the axis X, thus, an element close to the axis X is described as internal as opposed to an external element located radially on the periphery.

The terms "upper" and "lower" are used to define the relative position of one element with respect to another, with reference to a position in which the orifice 3 of the neck 2 is directed upwards and the cap 1 is in the closed position on the neck 2 of the container, an element intended to be placed lower being designated as lower and an element intended to be placed higher being designated as upper. The terms "in front" and "behind" are used to define the relative position of one element with respect to another along a diameter perpendicular to the axis X.

In relation to FIGS. 1 to 7, an assembly comprising a capping device and a container equipped with a neck 2, represented in FIGS. 2 to 5, is described below.

Figure 2:
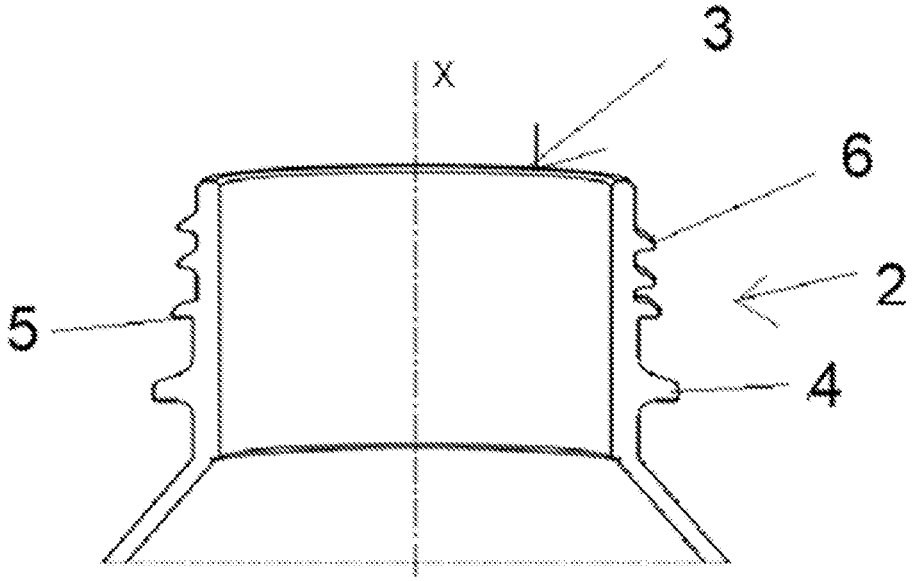
FIG. 2 is a sectional view of a container neck intended to receive the capping device of FIG. 1.

As shown specifically in FIG. 2, the neck 2 of the container includes an upper end in which an orifice 3 has been made that allows the content of the container to be poured. The neck 2 of the container includes a support collar 4 protruding radially outwards and an engaging flange 5 also protruding radially outwards and which is arranged axially between the support collar 4 and the orifice 3. A cylindrical portion is made axially between the support collar 4 and the orifice 3. On the other hand, the neck 2 includes, positioned axially between the engaging flange 5 and the orifice 3, a helical thread 6 formed by a series of helical ribs, which protrude radially towards the exterior from an external surface of the neck 2. The helical thread 6 is intended to cooperate with a complementary helical thread 7, represented in FIGS. 5 and 6, formed by a series of helical ribs that have been made on the cap 1 of the capping device. According to one embodiment, the helical thread 6 made on the neck 2, as well as the helical thread 7 made on the cap 1, are interrupted. In other words, the adjacent helical ribs are separated by a space that forms a vent and that allows, in particular, to evacuate the gas present inside the container while the cap 1 is still attached to the neck 2.

The capping device includes a lower ring 9 that is retained on the neck 2 of the container, a cap 1 that is intended to cover the orifice 3 of the container in order to seal it, and an articulation device 10 that connects the cap 1 to the lower ring 9. Cap 1 is movable between a closed position, shown in FIG. 1, and a released position, shown in FIG. 3, in which the cap 1 is no longer engaged with neck 2. Cap 1 is also suitable to tilt from the released position towards the tilted open position, represented in FIGS. 4 to 6, wherein the cap 1 is detached from the orifice 3 of the neck 2 so as not to hinder the pouring of the contents of the container. The capping device also includes a locking device arranged to lock the cap 1 in the open tilted position.

The cap 1 includes an upper wall 13 designed to be arranged substantially orthogonally to the axis X, facing the orifice 3 of the neck 2 when said cap 1 is in the closed position. The cap 1 additionally includes an external peripheral skirt 14 intended to surround the neck 2 of the container when the cap 1 is in the closed position. The external peripheral skirt 14 extends, downwards, perpendicular to the upper wall 13, from the external periphery of said upper wall 13. The helical thread 7 is made on the internal face of the external peripheral skirt 14.

Figure 5:
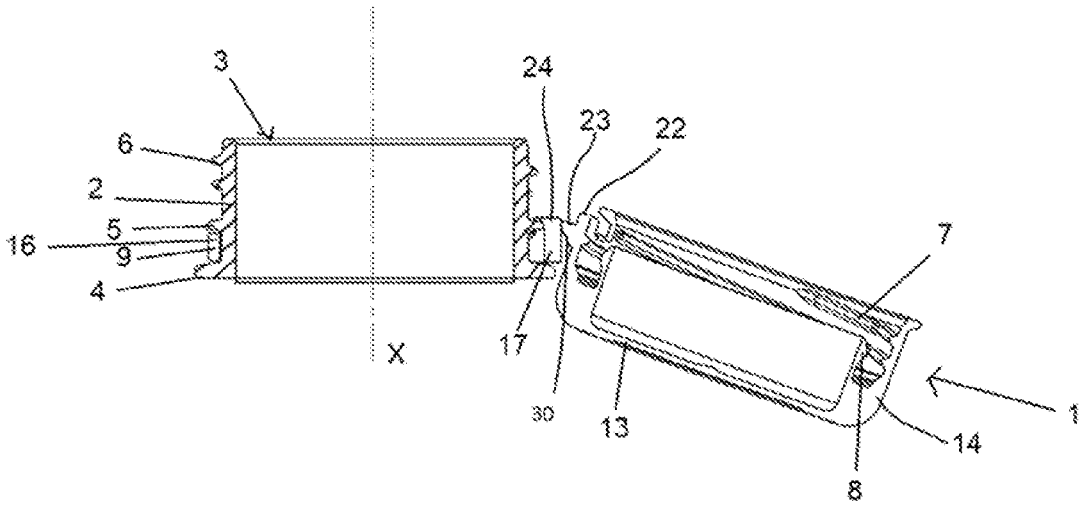
FIG. 5 is a sectional view of the capping device mounted on the neck of the container and showing the cap of the capping device in the tilted open position of FIG. 4.

As shown in particular in FIG. 5, the cap 1 includes an internal skirt 8, which extends perpendicularly downwards from the upper wall 13 of the cap 1 and is dimensioned so as to be inserted inside the orifice 3 of the neck 2, which ensures the tightness of the closure.

Advantageously, the lower ring 9 is, before the first opening of the container, connected to the cap 1 by frangible bridges, not illustrated, intended to break during the opening of the cap 1. These frangible bridges thus constitute tamperproof indicators.

Figure 3:
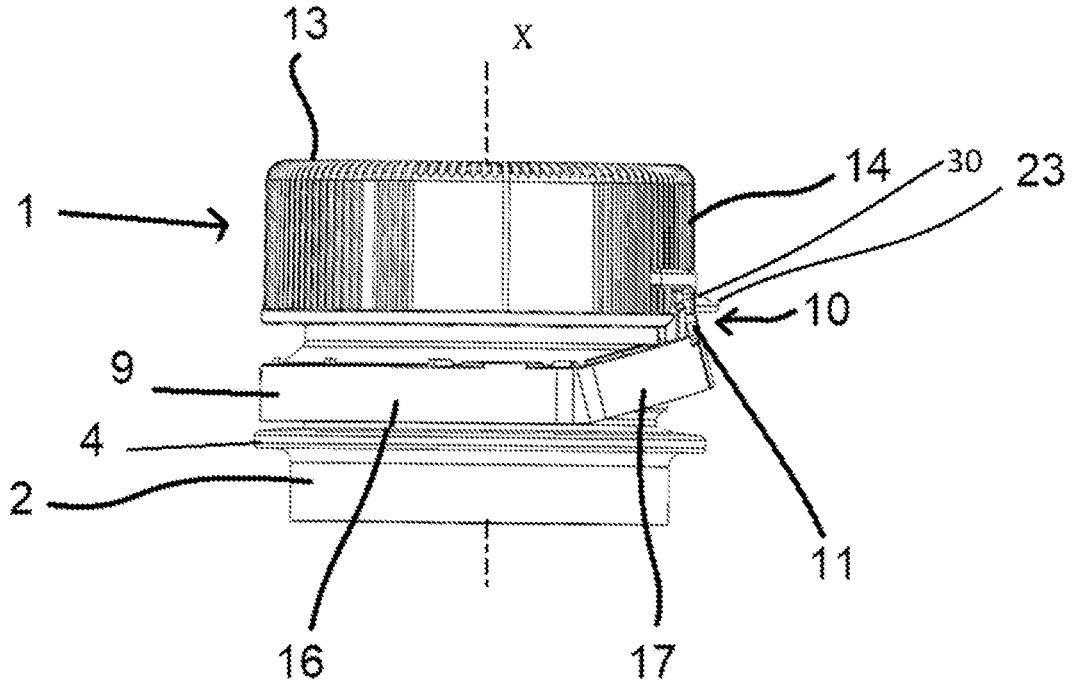
FIG. 3 is a side view of the capping device mounted on the neck of the container and showing the cap of the capping device in a released position where it is no longer engaged with the neck of the container.

The lower ring 9 is held axially on the neck 2 of the container while being able to rotate with respect to it around axis X. As shown in FIGS. 1 and 3 to 7, the lower ring 9 includes two parts that are hinged to each other, namely a first section 16 and a second section 17 whereby the lower ring 9 is connected to the cap 1 by means of the articulation device 10. In this way, as shown in FIG. 3, the second section 17 is able to pivot upwards with respect to the first section 16, between a lowered position in which at least most of the second section 17 is intended to be arranged below the engaging flange 5 and a raised position, in which at least most of the second section 17 is above the engaging flange 5. This allows the cap 1 to move upwards with respect to the neck 2 of the container, until the helical thread 7 of the cap 1 is released from the helical thread 6 made on the neck 2 of the container. In other words, when the cap 1 is unscrewed, the lower ring 9 is dragged in rotation about the axis X while the second section 17 of the lower ring 9 pivots with respect to the first section 16 to the raised position in order to allow an axial upward movement of the cap 1, from the closed position, to the released position, shown in FIG. 3. When the cap 1 pivots from the released position to the tilted open position, the second section 17 of the lower ring 9 pivots in the opposite direction with respect to the first section 16 and then returns to the lowered position. On the other hand, the second section 17 also pivots with respect to the first section 16 from the lowered position to the raised position, when the cap 1 pivots from the tilted open position to the released position.

The lower ring 9 is held axially on the neck 2 of the container by means of the engaging flange 5. As shown in FIG. 2, the engaging flange 5 has a frustoconical external surface that tapers upwards, that is, in the direction to the orifice 3 of the container. The engaging flange 5 delimits, downwards, that is, in a direction opposite to the orifice 3, a protrusion.

Figure 6:
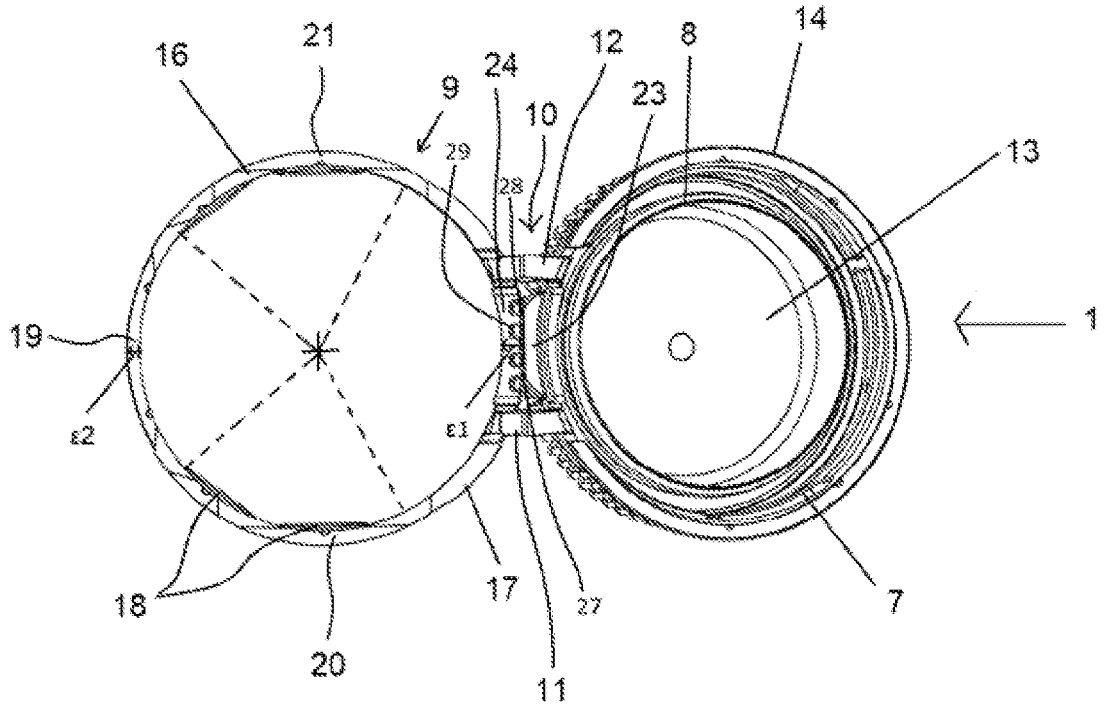
FIG. 6 is a top view of the capping device in the tilted open position of FIGS. 4 and 5.

As shown in FIG. 6, the first section 16 of the lower ring 9 includes engaging elements 18 that are intended to cooperate with the engaging flange 5 made on the container in order to axially retain the lower ring 9 to the neck 2 of the container. The engaging elements 18 are protuberances that protrude radially inwards from the first section 16 of the lower ring 9. Advantageously, the engaging elements 18 have a radial dimension that increases from bottom to top, that is, in the direction of the upper edge of the lower ring 9. During the assembly of the capping device on the neck 2 of the container, the engaging elements 18 slide against the frustoconical surface of the engaging flange 5 and are then immobilized by means of an elastic return behind the engaging flange 5.

Figure 7:
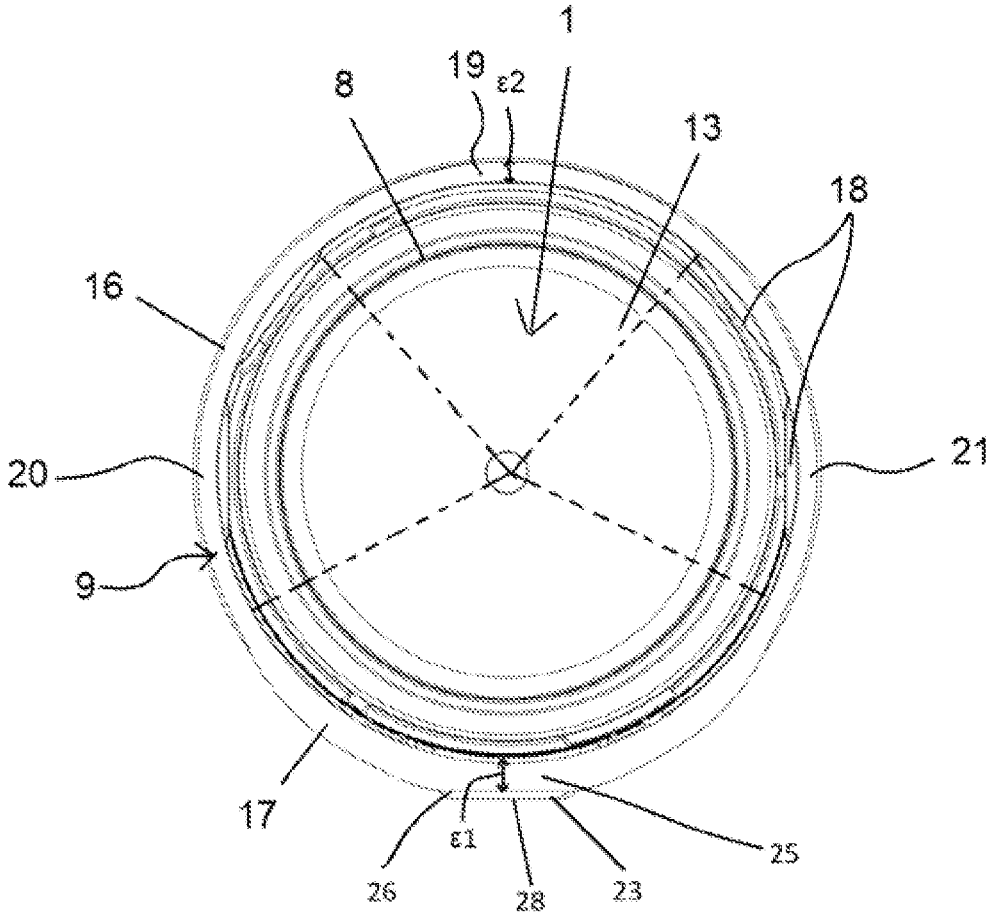
FIG. 7 is a bottom view of the capping device.

The first section 16 of the lower ring 9 includes a front area 19 that is diametrically opposite the second section 17 of the lower ring 9 and two engaging areas 20, 21 shown in FIGS. 6 and 7, which are arranged on one side and the other of the front area 19 and are arranged, each, between the front area 19 and the second section 17 of the lower ring 9. The engaging elements 18 are arranged exclusively in the two engaging areas 20, 21. In this way, due to the absence of engaging elements 18 in the front area 19 of the first section 16, there is a radial clearance between the lower ring 9 and the neck 2, which allows the lower ring 9 to move forward and backwards and vice versa. This makes it possible to facilitate the passage of part of the second section 17 from one side to the other of the engaging flange 5 during the movement of the second section 17 between the lowered position and the raised position. In other words, the tensile forces that will be exerted on the lower ring 9 to allow the second section 17 to pass from one side to the other of the engaging flange 5 are less.

Advantageously, the second section 17 extends over an angular range comprised between 9° and 150°, the front area 19 of the first section 16 extends over an angular range comprised between 6° and 150°, while each of the two engaging areas 20, 21 extends over an angular range comprised between 3° and 90°.

Figure 1:
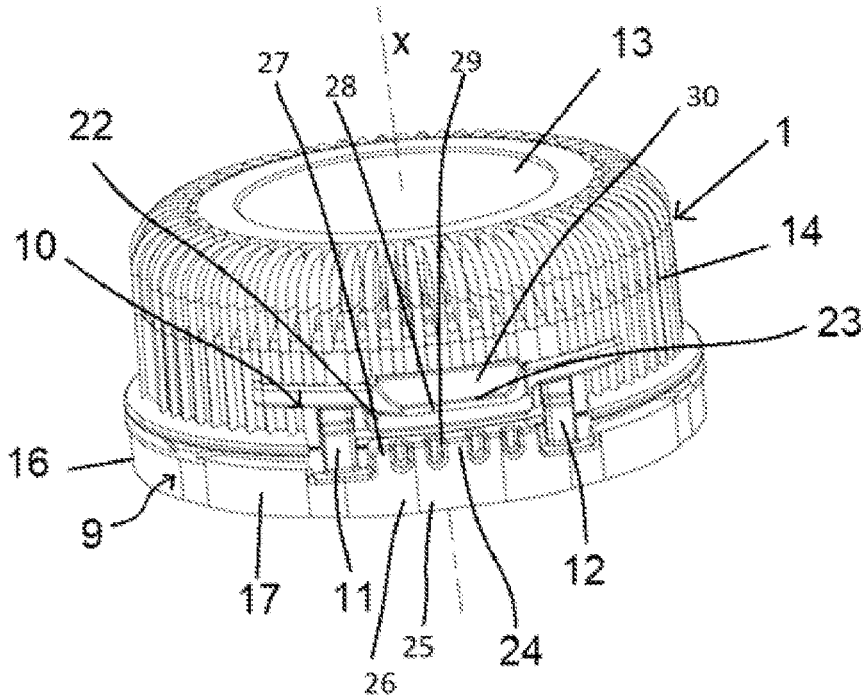
FIG. 1 is a rear perspective view of a capping device.
Figure 4:
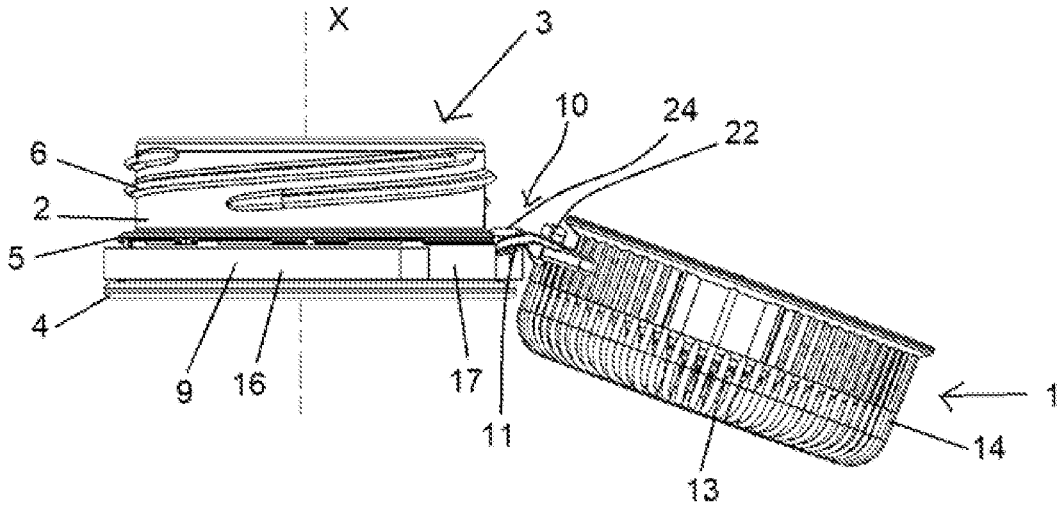
FIG. 4 is a side view of the capping device mounted on the neck of the container and showing the cap of the capping device in a tilted open position in which the cap is released from the orifice on the neck.

The articulation device 10 includes two sheets 11, 12, particularly visible in FIGS. 1 and 4, which connect the cap 1 and, more particularly, the external peripheral skirt 14 of the cap 1 to the lower ring 9, and more particularly, to the second section 17 of the lower ring 9.

The sheets 11, 12 join the outer peripheral skirt 14 at a notched portion. Similarly, the sheets 11, 12 join the second section 17 of the lower ring 2 in a notched portion. In other words, the sheets 11, 12 extend substantially above the lower limit of the outer peripheral skirt 9 and extend substantially below the upper limit of the lower ring 3.

The locking device includes a cap 23 protruding radially outwards from the outer peripheral skirt 14 of the cap 1. The stop 23 extends circumferentially between the two sheets 11, 12. The locking device also includes a protruding portion 24 protruding axially upwards, that is, towards the outer peripheral skirt 14 of the cap 1, from a central portion 25 of the second section 17 of the lower ring 9. The protruding portion 24 also protrudes between the two sheets 11, 12.

On the other hand, cap 1 includes a heel 22, specifically, visible in FIG. 1, which is formed in the external peripheral skirt 14 of the cap 1. The heel 22 protrudes axially downwards, that is, in the direction of the lower ring 9, from the external peripheral skirt 14 of the cap 1. The heel 22 protrudes between the two sheets 11, 12. The heel 22 thus makes it possible to limit the dimensions of the spaces and gaps made between the sheets 11, 12 and likely to receive some foreign bodies. By way of example, the height of the gap made axially between the heel 22 and the protruding portion 24 is less than 0.6 mm and preferably between 0.3 and 0.6 mm.

As shown in FIGS. 4 and 5, the stop 23 and the protruding portion 24 are arranged in such a way that, when the cap 1 is in the tilted open position, the stop 23 abuts against the protruding portion 24. The sheets 11, 12 as well as the stop 23 and the protruding portion 24 are configured in such a way that, during a first part of the movement of the cap 4 from the released position towards the tilted open position, the two elastic sheets 11, 12 are, due to the support of the stop 23 against the protruding portion 24, subjected to a tensile force that increases until an intermediate unstable position and then decreases from said intermediate unstable position towards the tilted open position. This allows cap 1 to be locked in the tilted open position.

As shown in FIGS. 6 and 7, the thickness of the lower ring 9 increases locally at least at the level of the protruding portion 24. Thus, the protruding portion 24 has a radial thickness ε1 that is greater than a radial thickness 82 of the first section 16 of the lower ring 9 outside some engaging areas 20, 21. This increase in the thickness of the lower ring 9 makes it possible to reduce, above all, the radial dimension of the stop 23.

On the other hand, the internal face and the external face 27 of the protruding portion 24 extend parallel to the axis X and are aligned according to the axial direction with the internal face and the external face 26 of the central portion 25 of the second section 17 of the lower ring 9. This ensures the continuity of the internal and external faces of the protruding portion 24 with that of the lower ring 9, without an angular surface.

On the other hand, in relation to FIG. 7, it can be seen that the outer face of the second section 17 of the lower ring 9 progressively moves away from the axis X from each of the ends of the second section to the central portion 25 of the second section 17, while the internal face of the second section 17 is incorporated in a concentric circle with the axis X. This allows the thickness of the lower ring 9 to be increased, at the level of the rear portion 25, by a progressive increase in the thickness of the second section 17, which makes it possible to avoid the presence of angular surfaces.

On the other hand, advantageously, as shown in FIG. 7, the external face 26 of the central portion 25 of the second section 17 as well as the external face 27 of the protruding portion 24 extend according to a plane perpendicular to a plane of radial symmetry of the capping device. Furthermore, the end 28 of the stop 23 is flat and parallel to the external faces 26, 27 of the central portion 25 of the second section 17 and of the protruding portion 24.

By way of example, the radial thickness ε1 of the protruding portion is between 0.4 and 2 mm and preferably between 1 and 2 mm.

Advantageously, as illustrated, for example, in FIGS. 1 and 6, the protruding part 24 has recesses 29. The recesses 29 open at the level of the free end of the protruding portion 24, as well as on the external face 27 of the protruding portion 24. Recesses 29 of this type are advantageous in that they facilitate the production by a molding process of a capping device that has a local increase of this type in the thickness of the lower ring 9 at the level of the protruding portion 24. Indeed, to mold a capping device of this type, the mold is equipped with a steel sheet intended to create the gap between the heel 22 and the protruding portion 24 in order to separate them. The increase in the radial thickness ε1 of the protruding portion 24 leads to an increase in the stresses exerted on the steel sheet during molding, which weakens it. However, it is prohibited to increase the thickness of this steel sheet in order to reinforce it, since this would lead to an increase in the height of the gap made between the heel 23 and the protruding portion 24 and, consequently, to the possibility that undesirable external bodies could be housed therein. Thus, in order to reinforce said steel sheet, it includes reinforcing ribs, the shape of which corresponds to that of the recesses 29 formed on the protruding portion 24.

On the other hand, as shown in FIG. 1, the stop 23 has an upper surface 30 that is bevel. In other words, the height of the stop 23 decreases from the outer peripheral skirt 14 towards the end 28 of the stop 23. Additionally, the end 28 of the stop 23 has a height of less than 1 mm, preferably less than 0.8 mm, for example, of the order of 0.6 mm. In this way, during the movement of the cap towards the tilted open position, the cap 1 tilts around the point of contact between the end 28 of the stop 23 and the protruding portion 24 until the upper surface 30 abuts against the protruding portion 24. The beveled shape of the upper surface 30 of the stop 23 thus allows the opening angle of the cap 1 to be increased in the tilted open position. In this way, the opening angle that corresponds to the protruding angular section that forms at the intersection between a plane parallel to the upper wall 13 of the cap 1 and a horizontal plane is greater than 180°, advantageously greater than 190° and, for example, of the order of 200°.

Advantageously, when the cap 1 is in the tilted open position, the protruding portion 24 is inserted between the stop 23 and the engaging flange 5. In other words, when the cap 1 is in the tilted open position, the stop 23 and the protruding portion 24 are in contact with each other in an area located in the plane of the engaging flange 5 and the protruding portion 24 is also in contact against the engaging flange 5. This makes it possible to guarantee a robust locking of the cap in the open tilted position.

The kinematics of chapter 1 is as follows. During the first unscrewing, the cap 1 leaves the closed position and moves away from the lower ring 9 to the released position, illustrated in FIG. 3. The frangible bridges break during this movement. Additionally, during this unscrewing movement of the cap 1, the lower ring 9 drags in rotation around the axis X and the second section 17 of the lower ring 9 pivots towards the raised position as the cap 1 moves away from the engaging flange 5.

Thereafter, the cap 1 can then pivot back toward the tilted open position wherein the outer peripheral skirt 14 extends upwardly from the top wall 13. During the rearward movement of the cap 1 toward its tilted open position, the stop 23 abuts against the protruding portion 24 and therefore causes the pivoting of the second section 17 of the lower ring 9 from the raised position towards the lowered position.

The possibilities of stretching the sheets 11, 10 together with the aforementioned features of the locking device, allow to create a hard point during the tilting of the cap 1 between the released position, represented in FIG. 3, and the tilted open position, represented in FIGS. 4 and 5.

As shown in FIGS. 5 and 6, when the second section 17 of the lower ring 9 is in the lowered position and the cap 1 is in its tilted open position, the stop 23 abuts against the protruding portion 24 which, in this way, is inserted between said stop 23 and the engaging flange 5.

In this way, the cap 1 remains in its open tilted position since, due to the arrangement mentioned above, the cap 1 cannot be pivoted towards the released position in which the cap 1 faces the dispensing orifice 3 while the second section 17 of the lower ring 9 remains in the lowered position.

To close the cap 1 again, the user tilts the cap 1 forward to the released position. During this tilting, the contact between the stop 23 and the protruding portion 24 disappears, which authorizes the movement of the second section 17 of the lower ring 9 towards the raised position.

When the second section 17 is in the raised position and the cap 1 is in the released position, said cap 1 can then be screwed back onto the neck 2 of the container. During threading, the lower ring 9 is dragged in rotation about the axis X and the second section 17 of the lower ring 9 pivots towards the lowered position as the cap 1 approaches the engaging flange 5.

Advantageously, the capping device assembly is molded in a single piece of synthetic material, such as polyethylene and advantageously high-density polyethylene. Advantageously, the capping device is molded in the configuration of FIG. 1, i.e. in a closed position, a position in which it can be mounted directly on the neck 2 of the container.

Although the invention has been described in relation to various particular embodiments, it is more than evident that it is not limited in any way by them and that it comprises all the technical equivalents of the means described, as well as their combinations if they fall within the scope of the invention.

The use of the verb "include", "comprise" or "consist of" and its conjugated forms do not exclude the presence of other elements or stages other than those established in a claim.

In the claims, any reference signs in parentheses are not to be construed as limiting the claim.

The invention claimed is:

1. A capping device intended to be fixed to a neck of a container that includes a dispensing orifice, a helical thread and an engaging flange, the capping device including:

a lower ring intended to be mounted axially fixed on the neck and mobile in rotation around an axis X, said lower ring including a first section that includes some engaging areas each including at least one engaging element that protrudes radially towards the interior of the lower ring and is intended to be arranged below the engaging flange in order to axially retain the lower ring on the neck of the container and a second section, the first section and the second section of the lower ring being articulated with each other so that the second section pivots with respect to the first section between a lowered position in which the second section is intended to be arranged below the engaging flange and a raised position in which the second section is intended to be arranged at least partially above the engaging flange, a cap including an upper wall and an external peripheral skirt, the external peripheral skirt having a helical thread intended to cooperate with the helical thread of the neck in order to allow the movement of the cap between a closed position and a released position in which the helical thread of the cap is no longer engaged with the helical thread of the neck;

an articulation device including two sheets that connect the outer peripheral skirt and the second section and configured to allow the cap to pivot between the released position and a tilted open position in which the cap is released from the dispensing orifice of the neck; the second section of the lower ring being able to be positioned in the lowered position when the cap is in the tilted open position;

the capping device further including a locking device configured to lock the cap when it is in the tilted open position, said locking device including:

a stop that protrudes radially outwards, from the external peripheral skirt, and is arranged circumferentially between the two sheets of the articulation device; and a protruding portion protruding axially from a central portion of the second section of the lower ring, between the two sheets of the articulation device;

the stop and the protruding portion being configured in such a way that, when the cap is in the tilted open position and the second section of the lower ring is in the lowered position, the stop abuts against the protruding portion, and wherein the outer peripheral skirt includes a heel that protrudes axially towards the protruding portion between the two sheets, the protruding portion having a radial thickness $\varepsilon 1$ greater than a radial thickness $\varepsilon 2$ of the first section of the lower ring outside some engaging areas and having recesses that open opposite the heel;

wherein the stop has a beveled upper surface oriented and a stop height, wherein the stop height decreases from the outer peripheral skirt towards a stop end, and wherein the beveled upper surface abuts against the protruding portion in the tilted open position.

2. The capping device according to claim 1, wherein the radial thickness $\varepsilon 1$ is comprised between 0.4 and 2 mm.

3. The capping device according to claim 1, wherein the protruding portion has an external face that extends axially in alignment with an external face of the central portion of the second section of the lower ring.

4. The capping device according to claim 3, wherein the sheets are symmetrical to each other with respect to a radial plane of symmetry and in which the external face of the protruding portion and the external face of the central portion of the second section of the lower ring extend in a plane that is perpendicular to said radial plane of symmetry.

5. The capping device according to claim 1 wherein the second section of the lower ring has two ends that are each connected to the first section of the lower ring and has an external face that moves away from the axis X from each of the two ends of the second section towards the central portion of said second section.

6. The capping device according to claim 1, including a gap that is established axially between the heel and the protruding portion and that has a height of less than 1 mm.

7. An assembly that includes a capping device according to claim 1 and a container equipped with a neck, the neck including a orifice, a helical thread and an engaging flange, being the engaging elements of the lower ring arranged below the engaging flange in order to axially retain the lower ring on the neck of the container.

8. The assembly according to claim 7, wherein the stop and the protruding portion are configured in such a way that, when the cap is in the tilted open position and the second section of the lower ring is in the lowered position, the protruding portion is trapped between the stop and the engaging flange.

9. The assembly according to claim 8, wherein the stop and the protruding portion are configured in such a way that, when the cap is in the tilted open position and the second section of the lower ring is in the lowered position, the stop and the protruding portion are in contact with each other in an area located in the plane of the engaging flange.

* * * * *